US005253682A

United States Patent [19]

Haskett et al.

[11] Patent Number: 5,253,682

[45] Date of Patent: Oct. 19, 1993

[54] FREE PISTON GAS DELIVERY APPARATUS AND METHOD

[76] Inventors: Carl E. Haskett, 15484 Wilana Dr., Tyler, Tex. 75713; John M. Cobb, 3400 Varsity Dr. Apt. 1916, Tyler, Tex. 75701

[21] Appl. No.: 807,146

[22] Filed: Dec. 13, 1991

[51] Int. Cl.[5] ..... B65B 1/04; B65B 3/04

[52] U.S. Cl. ..... 141/3; 141/5; 141/7; 141/67; 141/94; 141/197; 141/231; 141/286; 48/190; 92/258

[58] Field of Search ..... 141/1, 3, 4, 5, 7, 9, 141/37, 46, 65, 67, 94, 95, 100, 192, 197, 231, 285, 286, 25, 26, 38; 222/3, 249, 389; 48/190, 191, 192, 174; 220/563, 562, 23.83; 92/258, 257; 137/565, 571, 572

[56] References Cited

U.S. PATENT DOCUMENTS

| | | | |
|---|---|---|---|
| 1,005,976 | 10/1911 | Jones | 92/258 |
| 1,743,056 | 1/1930 | Whitaker | 222/389 |
| 1,892,519 | 12/1932 | Schottgen | 222/389 |
| 3,282,305 | 2/1964 | Antolak | 141/5 |
| 3,812,888 | 5/1974 | Dalton | 141/39 |
| 4,611,724 | 9/1986 | Watkins et al. | 220/563 |
| 4,649,968 | 3/1987 | Berrettini et al. | 141/95 |
| 4,750,869 | 6/1988 | Shipman, III | 417/345 |
| 4,805,674 | 2/1989 | Knowlton | 141/47 |

*Primary Examiner*—Henry J. Recla
*Assistant Examiner*—Steven O. Douglas
*Attorney, Agent, or Firm*—John M. Harrison

[57] ABSTRACT

A gas delivery apparatus which includes a vehicle fitted with multiple compressed gas cylinders, each provided with a free piston, along with a separate liquid reservoir cylinder, for sequentially displacing the gas located on one side of the free piston in each of the gas cylinders with liquid from the reservoir introduced on the opposite side of the free piston and relocating the free piston disposed in each gas cylinder by residual gas pressure. A method for dispensing compressed gas such as compressed natural gas from gas-filled cylinders containing a free piston and fitted with piping for introducing a liquid into each cylinder on one side of the piston to dispense gas from the opposite side of the piston, which method includes the steps of loading the cylinders with compressed gas, transporting the cylinders to a receiving reservoir location, attaching the gas side of the piston to the receiving reservoir, introducing water into the cylinder on the opposite side of the piston and forcing the piston through the cylinder to flow the gas from the cylinder into the reservoir.

17 Claims, 3 Drawing Sheets

FIG. 10

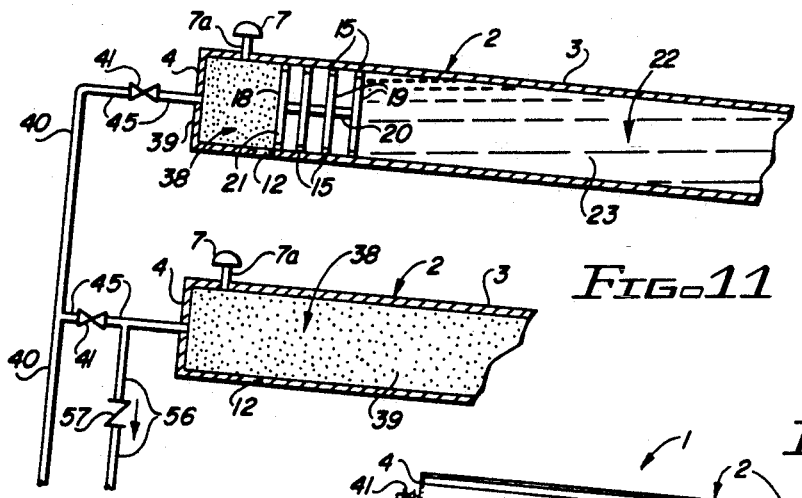
FIG. 11
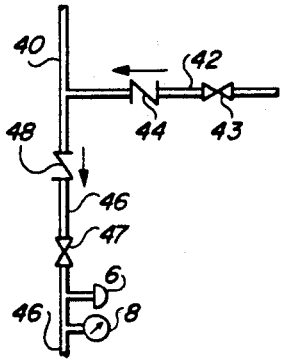
FIG. 12
FIG. 14
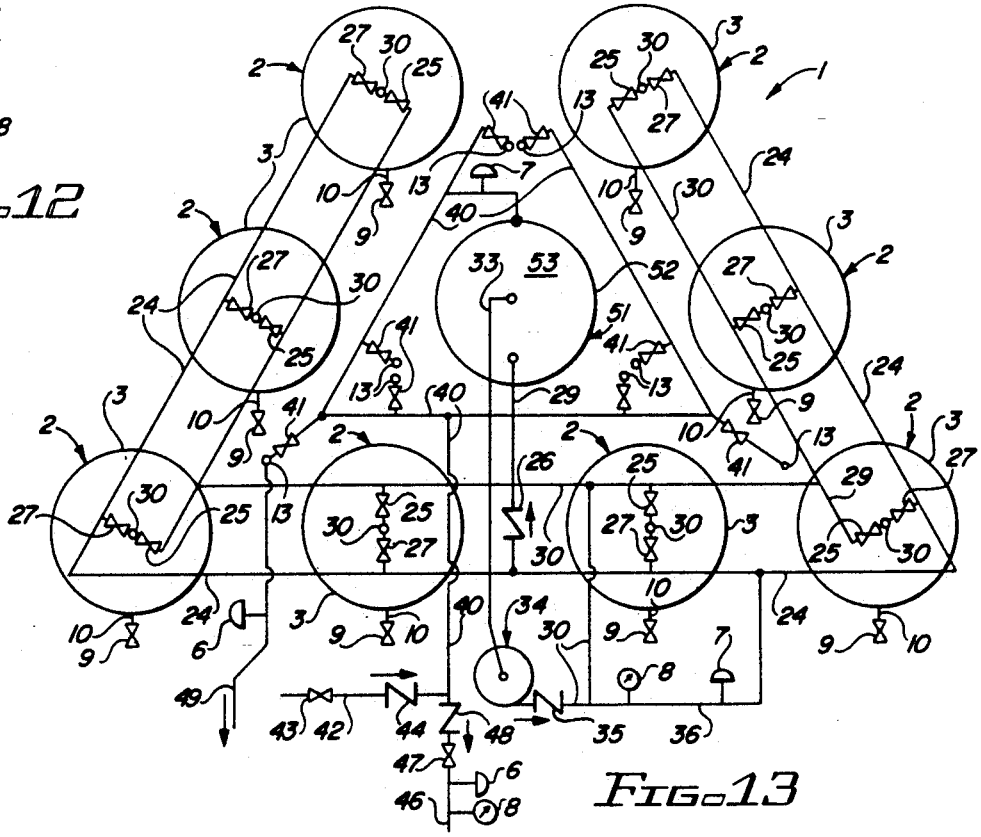
FIG. 13

FREE PISTON GAS DELIVERY APPARATUS AND METHOD

BACKGROUND OF THE INVENTION

1. Field of the Invention

This invention relates to loading, transportation and delivery of compressed gas such as compressed natural gas and more particularly, to a free piston compressed natural gas delivery apparatus and method for operating the apparatus. In a preferred embodiment, the free piston gas delivery apparatus includes one or more gas-filled cylinders, each fitted with a free piston and mounted on a truck or other vehicle, and at least one water-filled cylinder, also mounted on the vehicle, along with appropriate piping to facilitate coupling the gas-filled cylinders to a receiving reservoir and sequentially introducing water or other working fluid on the opposite side of the free piston from the gas in each cylinder and forcing the piston along the interior of the cylinder to displace the gas from the cylinder to the reservoir. Alternatively, tap water from any available source can be pumped into the cylinders according to the invention.

Due to current expensive and unreliable methods for transporting supplies of natural gas, oil and other petroleum products from various countries to the United States, the U.S. government is encouraging conversion of motor vehicles from gasoline to gaseous fuels such as compressed natural gas, or methane. If such a conversion could be effected in an economical manner, these vehicles, which include school bus fleets, passenger cars, trucks, buses and all other vehicles currently operating on gasoline or diesel fuel would be candidates for conversion to operation by compressed natural gas. However, a primary problem which arises in using compressed natural gas for powering motor vehicles is the fact that the user vehicle must be fueled to a pressure of about 2000 psi with compressed natural gas in order to obtain a practical driving range. If the delivery vehicle is restricted to a pressure under or about 4000 psi and is adapted to facilitate "bleeding" of the compressed natural gas from the delivery vehicle into the user vehicle, the resulting pressure in both the user vehicle and the delivery vehicle would be about 2000 psi. Accordingly, this transfer would facilitate delivery of only approximately one-half of the compressed natural gas carried in the delivery vehicle, an extremely inefficient mode of transfer. The problem is exacerbated under circumstances where an intermediate reservoir such as a tank or reservoir at a service station must be initially filled by the delivery vehicle and subsequently used to fill multiple user vehicles on an individual basis, in conventional fashion. Under these circumstances, the delivery vehicle might typically deliver compressed natural gas to the intermediate service station reservoir at a pressure of about 3000 psi. Accordingly, only about one-fourth of the compressed natural gas carried in the delivery vehicle could then actually be delivered to the user vehicle. Inefficiency of the transfer system is readily apparent, first, because delivery of one-fourth of the compressed natural gas originally loaded on the delivery truck is not cost-effective from the standpoint of useful freight, considering the weight of the cylinders and other equipment which must be hauled to the delivery point, and secondly, the time required for the delivery process becomes prohibitive as the pressure in the compressed natural gas truck slowly approaches the pressure in the receiving reservoir.

2. Description of the Prior Art

One of the techniques used to overcome the compressed natural gas delivery inefficiencies noted above involves using compressors located either on the compressed natural gas delivery truck or at the receiving station, to transfer the compressed natural gas from one reservoir to another. This facility allows delivery of a large quantity of the compressed natural gas transported in such a delivery truck, but the large amount of time required for compression and delivery becomes a major detrimental factor. Accordingly, both trucks and drivers are immobilized during the delivery sequence for long periods of time and the number of deliveries per day for each truck is seriously curtailed.

Pertinent prior art patents are as follows: U.S. Pat. No. 3,282,305, dated Nov. 1, 1966, to J.P. Antolak, entitled "Cylinder Filling Apparatus"; U.S. Pat. No. 4,649,968, dated Mar. 17, 1987, to B. J. Berrettini, entitled "Automatic Precision Liquid Loading Control System"; U.S. Pat. No. 3,812,888, dated May 28, 1974, to Charles R. Dalton, entitled "Compressed Liquid Gas Filling System"; U.S. Pat. No. 4,805,674, dated Feb. 21, 1989, to R. E. Knowlton, entitled "Natural Gas Storage and Retrieval System"; and U.S. Pat. No. 4,987,932, dated Jan. 29, 1991, to Robert M. Pierson, entitled "Process and Apparatus for Rapidly Filling a Pressure Vessel With Gas".

It is an object of this invention to provide a method and apparatus for delivering compressed gas, and compressed natural gas in particular, to a receiving reservoir from a cylindrical reservoir containing a free piston, by containing the gas on one side of the piston and displacing the gas from the reservoir by operation of the piston using a substantially incompressible fluid injected into the reservoir on the opposite side of the piston.

Another object of this invention is to provide a new and improved free piston gas delivery apparatus for delivering compressed gas such as compressed natural gas from a cylindrical reservoir having a sliding free piston, wherein the compressed natural gas is located on one side of the free piston and a substantially incompressible fluid such as water is pumped into the opposite side of the free piston to force the compressed natural gas from the reservoir by movement of the piston longitudinally along the interior of the cylindrical reservoir.

Still another object of this invention is to provide a free piston gas delivery apparatus which is characterized by one or more cylindrical, high pressure gas cylinders, each fitted with a free piston and appropriate plumbing for temporarily storing compressed natural gas on one side of the free piston and facilitating the sequential introduction of water on the opposite side of the free piston to displace the compressed natural gas from the cylinders by operation of the free piston.

Yet another object of this invention is to provide a method for transporting and delivering a compressed gaseous product such as compressed natural gas, which method includes the steps of loading the compressed natural gas into multiple, longitudinally tilted, cylindrical tanks or reservoirs containing a free piston, transporting the cylinders and compressed natural gas to a desired location for emptying into a receiving reservoir, introducing a substantially incompressible fluid such as water from a water storage cylinder sequentially into one end of the cylindrical reservoirs on the opposite side of the free piston from the compressed natural gas at a pressure greater than the pressure of the compressed natural gas and forcing the compressed natural gas from the cylindrical reservoirs into the receiving reservoir by operation of each free piston.

SUMMARY OF THE INVENTION

These and other objects of the invention are provided in a free piston gas delivery apparatus which is characterized in a preferred embodiment by a water reservoir and multiple, longitudinally-tilted, carrying and delivering gas cylinders, each fitted with a free piston capable of moving from one end of the cylinder to the other, along with suitable gas piping for injecting compressed natural gas into the cylinders in one end of the cylinders on one side of the piston and forcing each piston near the opposite end of the corresponding cylinders and suitable displacement fluid piping for sequentially pumping a relatively incompressible displacement fluid such as water, into each cylinder on the opposite side of the free piston and forcing the compressed natural gas from the cylinders by operation of the free piston. A method for loading, transporting and unloading compressed natural gas to and from multiple, longitudinally-tilted cylinders, each fitted with a free piston and appropriate gas and liquid piping, which method includes the steps of loading a quantity of compressed natural gas into the cylinders by conventional techniques and forcing each free piston from the gas end to the liquid end of the cylinders, respectfully; transporting the compressed natural gas at a selected pressure to a receiving reservoir; and sequentially pumping water into the liquid end of the cylinders at a pressure which exceeds the pressure of the compressed natural gas to force the free piston from the liquid end to the gas end of the cylinders and flowing the compressed natural gas from the gas end of the cylinders into the receiving reservoir.

BRIEF DESCRIPTION OF THE DRAWINGS

The invention will be better understood by reference to the following drawings, wherein:

FIG. 11 is a side sectional view and schematic of the gas end of a pair of gas cylinders, more particularly illustrating the compressed natural gas unloading sequence;

FIG. 12 is a schematic diagram of a preferred delivery piping system for delivering compressed natural gas from the respective gas cylinders to a reservoir;

FIG. 13 is a schematic view of the rear end of a preferred embodiment of the free piston gas delivery apparatus, more particularly illustrating both the water and gas piping system for sequentially introducing water into the respective gas cylinders and forcing compressed natural gas from the gas cylinders to a receiving reservoir; and FIG. 14 is a side view of the free piston gas delivery apparatus of this invention mounted on a delivery truck.

DESCRIPTION OF THE PREFERRED EMBODIMENTS

Figure 1:
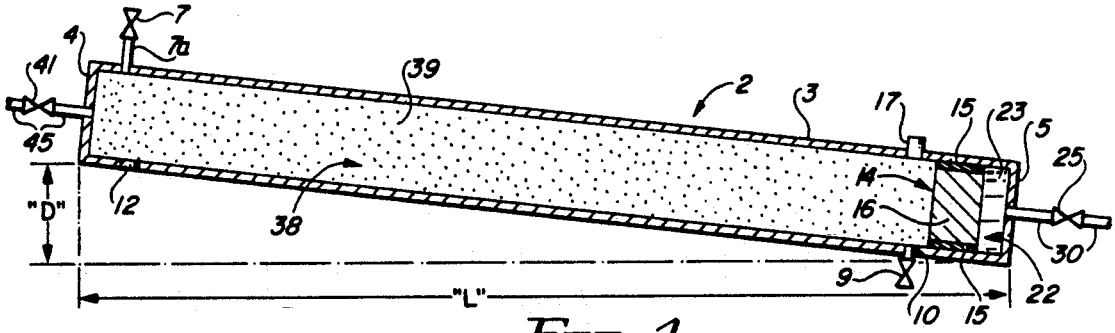
FIG. 1 is a side sectional view and schematic of a typical gas cylinder loaded with compressed natural gas and illustrating a unitary free piston and a preferred gas end elevation.
Figure 2:
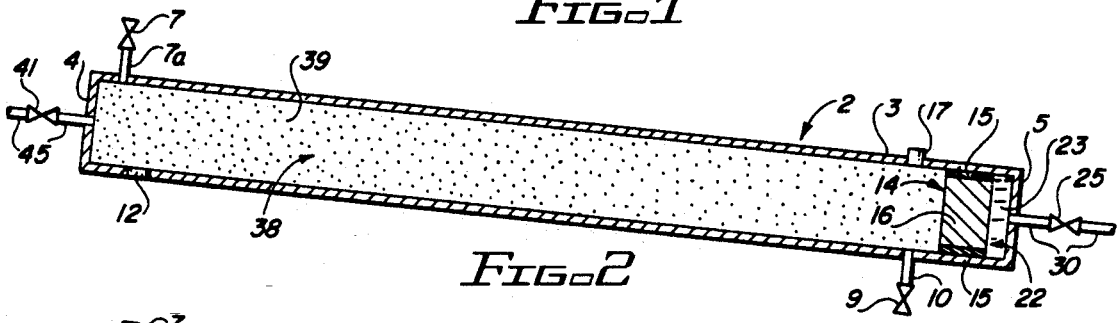
FIG. 2 is a side sectional view and schematic of the gas cylinder illustrated in FIG. 1, more particularly illustrating a first unloading phase of the compressed natural gas in the gas cylinder.
Figure 3:
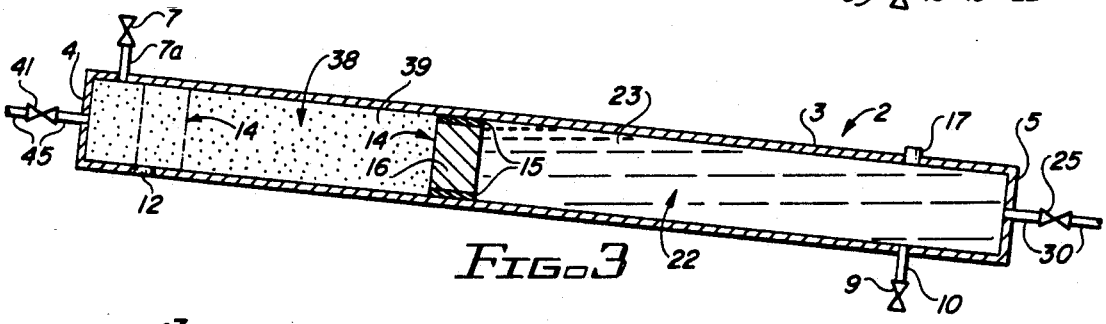
FIG. 3 is a side sectional view and schematic of the gas cylinder illustrated in FIGS. 1 and 2, more particularly illustrating the final unloading phase of compressed natural gas from the gas cylinder.
Figure 4:
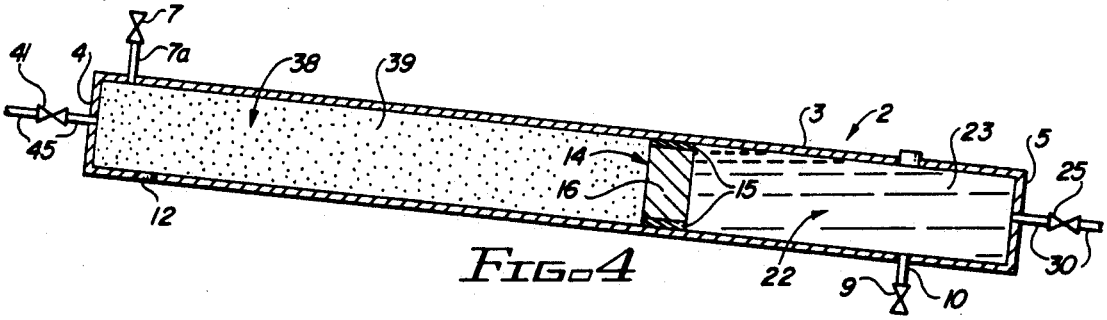
FIG. 4 is a side sectional view and schematic of gas cylinders illustrated in FIGS. 1-3, more particularly illustrating the unitary free piston recovery phase of the compressed natural gas unloading cycle.

Referring initially to FIGS. 1-6 and 14 of the invention, the free piston gas delivery apparatus of this invention is generally illustrated by reference numeral 1, as shown in in FIG. 14. In a preferred embodiment the free piston gas delivery apparatus 1 is mounted on the flat truck bed 64 of the delivery truck 63 (illustrated in phantom) and is stabilized on the truck bed 64 by a vertical front cylinder support 65 and rear cylinder support 66. It will be appreciated from a consideration of FIGS. 1-6 and 14 that the gas end 4 of each gas cylinder 2 is elevated above the water end 5 by means of the front cylinder support 65 and rear cylinder support 66, for purposes which will be hereinafter further described. In a most preferred embodiment of the invention each gas cylinder 2 is characterized by a cylindrical gas cylinder shell 3 and the gas end 4 of the gas cylinder shell 3 is elevated one diameter "D" of the gas cylinder shell 3 above the water end 5 along the entire length "L" of the gas cylinder shell 3, as illustrated in FIG. 1. Each of the gas cylinders 2 illustrated in FIGS. 1-6 is further provided with a unitary free piston 14, having a solid piston body 16 and optionally fitted with piston seals 15, for sliding essentially along the entire length of the gas cylinder 2, as hereinafter further described. A pressure relief valve 7 is provided on a corresponding valve nipple **7*a* projecting from the gas cylinder shell 3 of each gas cylinder 2, which valve nipple 7*a* communicates with the gas chamber 38, defined by the gas cylinder shell 3, gas end 4 and the unitary free piston 14. A water chamber 22 is also provided in the gas cylinder 2 and is defined by the gas cylinder shell 3, water end 5 and the unitary free piston 14, as further illustrated in FIGS. 1-6. Accordingly, it will be appreciated from a consideration of FIGS. 1-6 that each gas cylinder 2 is characterized by a gas chamber 38 for containing a quantity of compressed natural gas 39 on one side of the unitary free piston 14 and a water chamber 22, adapted to receive and contain a quantity of water 23, located on the opposite side of the unitary free piston 14 from the compressed gas 39. As further illustrated in FIGS. 1-5, a water supply line 30 projects through the water end 5** of each of the gas cylinders 2 and is fitted with a water supply line valve 25 for controlling the flow of water through the water supply line 30, into the water chamber 22 of each gas cylinder shell 3. Similarly, referring to FIGS. 1-4, 6 and 11 of the drawings, a gas delivery line 40, illustrated in FIG. 11, is coupled to the respective delivery line nipples 45, which extend through the gas end 4 of each of the gas cylinders 2 and are each fitted with a delivery line valve 41, for controlling the flow of compressed gas 39 to and from the gas chamber 38 in the gas cylinder shell 3. A drain line 10 is also provided in the gas cylinder shell 3 of each gas cylinder 2, spaced from the water end 5 and communicates with the water chamber 22 of each gas cylinder 2. A drain valve 9 is provided in each drain line 10 to facilitate draining water 23 from each water chamber 22, as deemed necessary.

Figure 7:
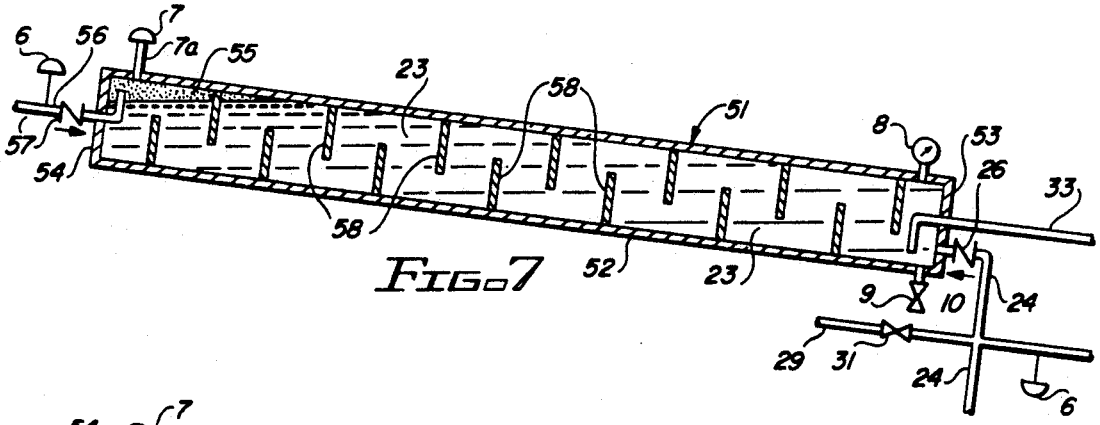
FIG. 7 is a side sectional view and schematic of a preferred water cylinder element of the free piston gas delivery apparatus of this invention, more particularly illustrating a top and bottom staggered baffle system.
Figure 8:
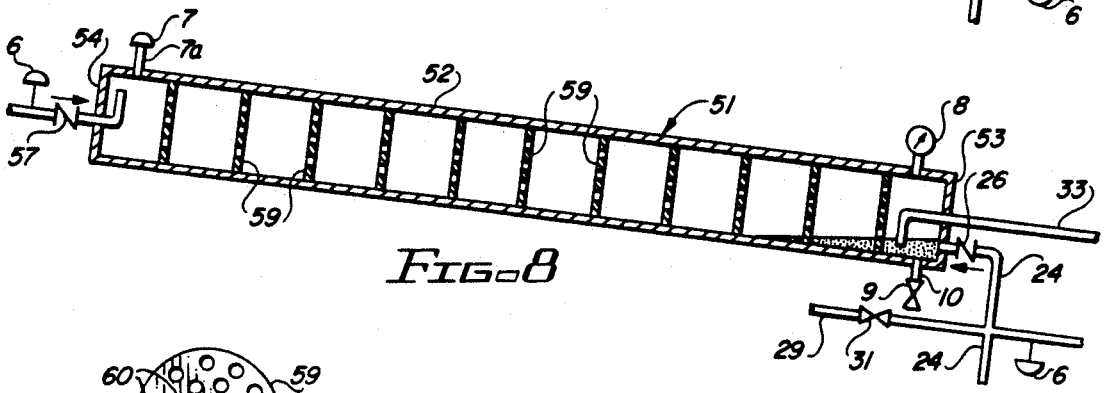
FIG. 8 is an alternative preferred embodiment of the water cylinder illustrated in FIG. 7, illustrating a sieve plate baffle system.
Figure 9:
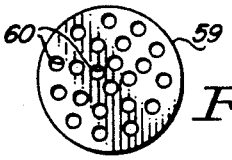
FIG. 9 is a front view of a sieve plate provided in spaced relationship in the water cylinder illustrated in FIG. 8.

Referring now to FIGS. 7, 8 and 9 of the drawings and to FIGS. 7 and 8 initially, the water cylinder 51 includes a cylindrical water cylinder shell 52 which is closed at an operational end 53 and a gas pad supply end 54, as illustrated. In a first preferred embodiment of the invention, multiple top and bottom, semicircular baffles 58 are spaced in alternating relationship in the interior of the water cylinder shell 52 for baffling the water 23 located in the water cylinder 51 and minimize surging of the water 23 when the delivery truck 63 stops and starts during the transportation process as illustrated in FIG. 7. Drain openings (not illustrated) are provided in the bottom ones of the baffles 58 to facilitate drainage of water to the operational end 53 of the water cylinder 51. In another preferred embodiment of the invention the semicircular baffles 58 are replaced by sieve plates 59, fitted with multiple plate openings 60, as more particularly illustrated in FIGS. 8 and 9. A pressure relief valve 7 is located in the water cylinder shell 52 near the gas pad and supply end 54 of both the water cylinders 51 illustrated in FIGS. 7 and 8 and is secured to a valve nipple 7a, which communicates with a gas pad 55, located in the interior of the water cylindrical shell 52, as illustrated in FIG. 7. The gas pad 55 is normally located in the relative position illustrated in FIG. 7 since, like the gas cylinder 2, the water cylinder 51 is tilted, with the gas pad supply end 54 located one diameter of the water cylinder shell 52 above the operational end 53. A pressure gauge 8 is provided at the opposite end of the water cylinder shell 52 near the operational end 53, for indicating the pressure of the water 23 located inside the water cylinder shell 52. A pump suction line 33 projects through the operational end 53 of the water cylinder 51 and a water return line 24 also projects into the water cylinder 51 through the operational end 53 and is provided with a water return line check valve 26, to facilitate unidirectional flow of the water 23 through the water return line 24 into the water cylinder 51, as hereinafter further described.

Referring to FIGS. 7 and 11, a gas pad supply line 56 projects into the water cylinder 51 through the gas pad supply end 54 and is upwardly turned into the gas pad 55, for supplying the gas pad 55 to the water cylinder 51. A gas pad supply line check valve 57 is provided in the gas pad supply line 56 to insure that the gas pad 55 cannot flow from the interior of the water cylinder 51 back through the gas pads supply line 56. A pressure regulator 6 is also provided in the gas pad supply line 56 to regulate the pressure of compressed gas flowing from one of the gas cylinders 2, through the gas pad supply line check valve 57, illustrated in FIG. 11, through the gas pad supply line 56 into the gas pad 55.

Figure 10:
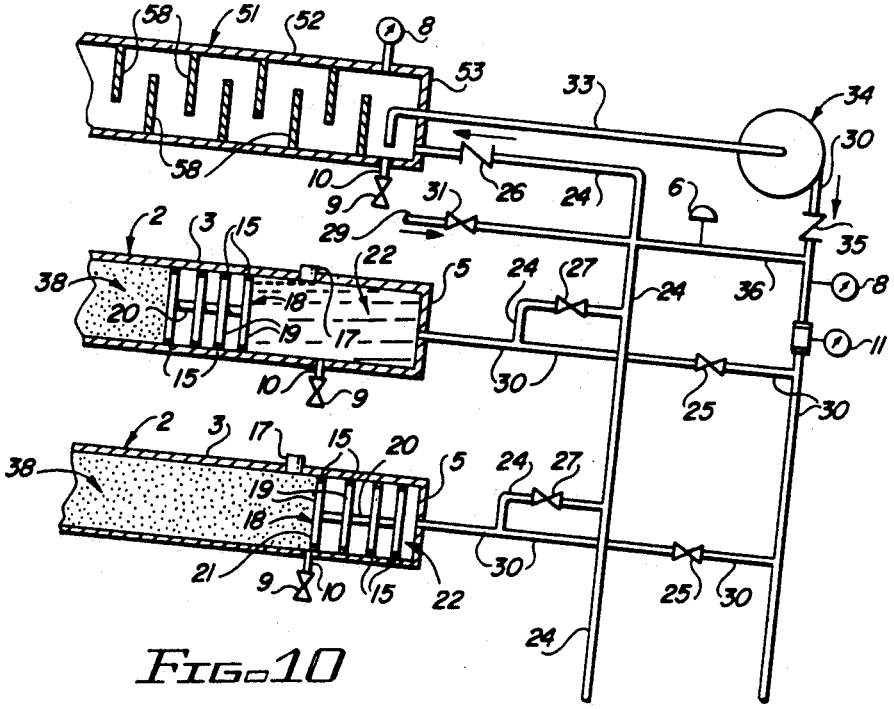
FIG. 10 is a side sectional view and schematic of the water end of a pair of gas cylinders and the discharge end of a water cylinder, more particularly illustrating a multiple wafer piston and a preferred compressed natural gas unloading sequence.

Referring now to FIGS. 10, 11 and 13 of the drawings, in a most preferred embodiment of the invention the free piston gas delivery apparatus is characterized by eight gas cylinders 2 and a single water cylinder 51, arranged on the delivery truck 63 in the triangular configuration illustrated in FIG. 13. The gas cylinders 2 may be fitted with the unitary free pistons 14, illustrated in FIGS. 1-6, or with the multiple wafer pistons 18, each having multiple piston wafers 19, spaced on a common piston shaft 20, as illustrated in FIGS. 10 and 11. The key ingredient in the water circulation system of the free piston gas delivery apparatus 1 is the water pump 34, which is most preferably a positive displacement pump, receiving water from the water cylinder 51 through the pump suction line 33, as illustrated. The water is pumped from the water cylinder 51 through the pump suction line 33 by operation of the water pump 34, into the water supply line 30 through a pump discharge check valve 35. The water supply line 30 is further provided with a pressure gauge 8 and an optional volume gauge 11, for determining the pressure and volume of water flowing through the water supply line 30. The water supply line 30 serves each of the gas cylinders 2 at the water end 5 of the gas cylinders 2 and a water supply valve 25 controls the flow of water from the water supply line 30 into the water end 5 of the respective gas cylinders 2. The water return line 24 is connected to the water supply line 30 and also serves each of the gas cylinders 2 and a water return line valve 27 is provided at each water end 5 of the respective gas cylinders 2, to facilitate water flow from the water supply line 30 through the water supply line valve 25 and water return line valve 27, to bypass all or any one of the gas cylinders 2, as illustrated in FIGS. 10 and 13. Accordingly, it will be appreciated from a consideration of FIGS. 10 and 13 that water may be sequentially pumped by operation of the water pump 34 through the water supply line 30 and the respective water supply line valves 25 and into each respective gas cylinder 2 through the corresponding water end 5, to facilitate discharging the compressed gas from each respective gas chamber 38 by operation of the unitary free piston 14 or multiple wafer pistons 18, as the case may be. A water recycle line 36 connects the water supply line 30 and the water return line 24, to facilitate recirculation of water from the water cylinder 51 through the water pump 34 and back to the water cylinder 51, under circumstances where the water supply line 30 is blocked, either by inadvertent closure of a corresponding water supply line valve 25 or otherwise, to prevent damage to the system. In this regard, a pressure regulator 6 is provided in the water recycle line 36 to facilitate automatic recirculation of the water through the water recycle line 36 when the water pressure rises above a predetermined point in the water supply line 30 and water return line 24.

Referring now to FIGS. 11-14 and initially to FIG. 13, a fuel supply line 49 communicates with the gas end 4, illustrated schematically as the gas cylinder connecting terminals 13 in FIG. 13, for supplying gas such as compressed natural gas from the respective gas cylinders 2 to operate the water pump 34 or the delivery truck 63, if necessary. Under normal circumstances, the delivery truck 63 and pump engine (not illustrated) which operates the water pump 34 each contain a separate fuel supply in conventional fashion. However, in an emergency, the fuel supply line 49 facilitates tapping of the respective gas cylinders 2 to supply the necessary fuel. A pressure regulator 6 is provided in the fuel supply line 49 to regulate the pressure of the compressed natural gas flowing from the respective gas cylinders 2 into the appropriate reservoir or tank (not illustrated), for supplying the delivery truck 63 and pump engine with fuel.

As further illustrated in FIGS. 10–14, with particular emphasis on FIGS. 10 and 13, the water supply and return system in the gas delivery system of the free piston gas delivery apparatus 1 facilitate sequential filling of the gas cylinders 2 with compressed natural gas and subsequently sequentially emptying each respective gas cylinder 2 by operation of the water delivery and return system. In a most preferred embodiment of the invention, the water cylinder 51 is supported in the center of a triangular-shaped cluster of gas cylinders 2, arranged on the truck bed 64 of the delivery truck 63, as illustrated in FIGS. 13 and 14. Water is delivered on demand from the operational end 53 of the water cylinder 51 to the water pump 34 and the water is then pumped at high pressure through the pump discharge check valve 35 and water supply line 30, sequentially to the water end 5 of each of the gas cylinders 2 through the corresponding water supply line valves 25, respectively. When each corresponding gas cylinder 2 is substantially empty of compressed natural gas, the water is returned from the gas cylinder 2, respectively, through the water return line valve 27 and the water return line 24 and finally, through the water return check valve 26, back into the water cylinder 51. A makeup water line 29 is connected to the water return line 24 and includes a makeup water line valve 31 for injecting makeup water into the water cylinder 51, as necessary. Similarly, and referring now to FIGS. 11–13 of the drawings, compressed natural gas is initially/loaded sequentially into each of the gas cylinders 2 through a gas fill line 42, provided with a fill line valve 43, which gas fill line 42 communicates with a gas delivery line 40. The gas delivery line 40, in turn, communicates with the gas end 4 of each of the gas cylinders 2 by means of a delivery line nipple 45, which receives a gas delivery line valve 41. A fill line check valve 44 is provided in the gas fill line 42 to prevent back flowing of compressed natural gas from the gas delivery line 40 when compressed natural gas is being delivered from each of the gas cylinders 2 to a customer reservoir (not illustrated), through the gas loading line 46, which also communicates with the gas delivery line 40. Like the gas fill line 42, the gas loading line 46 is provided with a loading line valve 47 and a loading line check valve 48 and is further fitted with a pressure regulator 6 and a pressure gauge 8, for controlling and monitoring the loading pressure of the compressed natural gas as it flows through the gas loading line 46.

In operation, and referring again to FIGS. 1–6 and 10–13, when it is desired to load the gas cylinders 2 with a compressed gas such as compressed natural gas, the delivery truck 63 is maneuvered to a source of compressed natural gas, such as a storage tank or reservoir (not illustrated) and the gas fill line 42 is coupled to the source of supply or reservoir. The gas delivery line valve 41, located in a corresponding delivery line nipple 45 of a selected gas cylinder 2, is then manually opened and compressed natural gas is allowed to flow through the gas fill line 42, the gas delivery line 40 and the open gas delivery line valve 41, into the gas chamber 38 of the corresponding gas cylinder 2. Pressure of the incoming compressed natural gas 39 located in the gas chamber 38 forces the unitary free piston 14, illustrated in FIGS. 1–6, or the multiple wafer piston 18, illustrated in FIGS. 10 and 11, away from the gas end 4, toward the water end 5 of the gas cylinder shell 3. When the unitary free piston 14 or multiple wafer piston 18 reaches a predetermined proximity with respect to the water end 5 of the gas cylinder shell 3, which predetermined point may be determined by a magnetic or electrical piston sensor 17, the open gas delivery line valve 41 is manually closed and a second gas delivery line valve 41 is manually opened, to repeat the filling procedure in another gas cylinder 2. After each gas chamber 38 of the respective gas cylinders 2 is fitted with compressed natural gas 39 by operation of the filling procedure described above, the last gas delivery line valve 41 is manually closed and the gas loading line 46 is uncoupled from the compressed natural gas storage tank or reservoir. If the water cylinder 51 element of the free piston gas delivery apparatus 1 is empty, makeup water from a suitable source (not illustrated), is injected into the water cylinder 51 through the makeup water line 29 and makeup water line valve 31 and through the water return line 24 and water return line check valve 26. When the water cylinder 51 is substantially full, a gas pad 55 is introduced into the water cylinder 51 through the gas pad supply line 56, which communicates with the delivery line nipple 45, serving one of the gas cylinders 2, as illustrated in FIG. 11. Accordingly, compressed natural gas 39 is allowed to flow from the gas cylinder 2 through the delivery line nipple 45, gas pad supply line 56, gas pad supply line check valve 57 and into the gas pad supply end 54 of the water cylinder 51, as illustrated in FIGS. 7 and 11 of the drawings.

After the gas chambers 38 of each of the gas cylinders 2 are filled with compressed natural gas 39 and the water cylinder 51 is filled with water as described above, the delivery truck 63 is driven to a gas receiving site for unloading all or a portion of the compressed natural gas 39 in a user reservoir or tank (not illustrated). The unloading process is initiated by first coupling the gas loading line 46 to a corresponding loading fitting (not illustrated) provided in the user reservoir or tank and subsequently manually opening one of the gas delivery line valves 41, seated in a corresponding delivery line nipple 45 of a gas cylinder 2. The water supply line valve 25 corresponding to the gas cylinder 2 having the open gas delivery line valve 41 is then manually opened and the water pump 34 is operated, to pump water from the water cylinder 51, through the pump suction line 33 and water supply 30 and then through the open water supply line valve 25, into the water end 5 and water chamber 22 of the gas cylinder 2, as heretofore described. When the water pressure in the water chamber 22 of the gas cylinder shell 3 exceeds the pressure of the compressed natural gas 39 in the gas chamber 38, the unitary free piston 14 or multiple wafer piston 18, as the case may be, is forced to move away from the water end 5 toward the gas end 4 of the gas cylinder shell 3. This action forces the compressed natural gas 39 located in the gas chamber 38, through the delivery line nipple 45, gas delivery line valve 41 and gas delivery line 40, as well as the gas loading line 46, into the user reservoir or tank (not illustrated). Continued movement of the unitary free piston 14 or multiple wafer piston 18 toward the gas end 4 in the gas cylinder shell 3 continues to sweep compressed natural gas 39 from the gas chamber 38 until the unitary free piston 14 or multiple wafer piston 18 reaches the fluid sensor 12, whereupon the gas delivery line valve 41, serving the operating gas cylinder 2, is manually closed, leaving a residual supply of gas 39 in the gas chamber 38 between the unitary free piston 14 or multiple wafer piston 18 and the gas end 4 of the gas cylinder shell 3. At this point the open water supply line valve 25 which serves the operating gas cylinder 2, is manually closed and the corresponding water return line valve 27 is manually opened to facilitate return of water from the water chamber 22 of the gas cylinder shell 3 of the operating gas cylinder 2, through the water return line 24 and back to the water cylinder 51. Since the pressure of the gas 39 in the gas chamber 38 of the gas cylinder shell 3 is greater than the pressure of the water in the water chamber 22 after the water return line valve 27 is opened, water begins flowing from the water chamber 22 through a short segment of the water supply line 30 and subsequently through the water return line 24, water return line valve 27, water return line check valve 26 and back into the water cylinder 51. This flow of water from the operating gas cylinder 2 to the water cylinder 51 is facilitated in a continuing flow by reverse movement of the unitary free piston 14 or multiple wafer piston 18, from close proximity to the gas end 4 toward the water end 5 of the operating gas cylinder 2. When the unitary free piston 14 or multiple wafer piston 18 has reached a predetermined position in close proximity to the water end 5 of the operating gas cylinder 2, the water return line valve 27 is again manually closed and the process is repeated with respect to a second and then subsequent gas cylinders 2.

Figure 5:
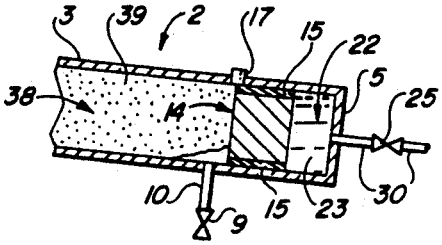
FIG. 5 is a side sectional view and schematic of the water end of the gas cylinder illustrated in FIGS. 1-4.
Figure 6:
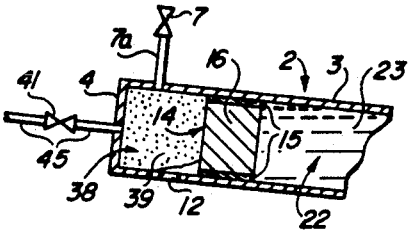
FIG. 6 is a side sectional view and schematic of the gas end of the gas cylinder illustrated in FIGS. 1-4.

It will be appreciated by those skilled in the art that in a preferred embodiment of the invention, the water cylinder 51 is slightly larger in capacity than each of the gas cylinders 2, to facilitate filling of the respective delivery and water lines, as well as sequentially filling the water chambers 22 of each of the gas cylinders 2 in the compressed natural gas unloading process. Furthermore, it will also be appreciated that the magnetic or electric piston sensor 17, illustrated in FIGS. 1–5 and 10, can be used to determine the precise location of the unitary free piston 14 or multiple wafer piston 18 inside the respective gas cylinders 2 near the water end 5, according to the knowledge of those skilled in the art. Furthermore, the fluid sensor 12, located in the bottom of the gas cylinder shell 3 of the gas cylinder 2 as illustrated in FIGS. 1–4, 6 and 11, senses any water seepage 21 which may seep past the unitary free piston 14 or multiple wafer piston 18, into the gas chamber 38, as illustrated in FIGS. 10 and 11. However, it is understood that the differential pressure across either the unitary free piston 14 or multiple wafer piston 18 at any given time during the compressed natural gas unloading process is very small and seepage of water from the water chamber 22 into the gas chamber 38 is therefore minimal. Moreover, should a small quantity of water leak pass the respective piston seals 15 provided in the unitary free piston 14 or multiple wafer piston 18, this water can be easily sensed by the fluid sensor 12 as illustrated in FIG. 11 and may be drained from the system through the drain line 10 using the drain valve 9, when the unitary free piston 14 or multiple wafer piston 18 is retracted into the pre-gas discharging configuration illustrated in FIGS. 1, 2 and 10. This drainage is facilitated by the tilting of each of the gas cylinders 2 in the manner illustrated in the drawings to pool the water inside the gas cylinder shell 3, as illustrated in FIG. 5.

Referring again to FIG. 7 of the drawings, it will be appreciated that the gas pad 55 located in the water cylinder 51 serves a dual purpose. First, the gas pad 55 serves to provide a positive pressure on the water located in the water cylinder 51 to continually prime the water pump 34 and insure that the positive displacement water pump 34 operates properly when needed. Secondly, the gas pad 55 serves to prevent air from accumulating in the water cylinder 51 and causing corrosion inside the water cylinder shell 52.

It will be further appreciated by those skilled in the art that travel of the unitary free piston 14 or multiple wafer piston 18 toward the gas end 4 of the gas cylinder 2 may be limited by observing the volume gauge 11, provided in the water supply line 30, while the water pump 34 is operating, to effect unloading the compressed natural gas sequentially from the gas cylinders 2. Otherwise, the piston travel may be limited by stops (not illustrated) provided in the gas cylinder shell 3 or by operator experience.

It will also be appreciated by those skilled in the art that under circumstances where the compressed natural gas undergoes a rapid depressurization from a high pressure, for example, 4000 lbs. per square inch to perhaps 2000 lbs. per square inch, hydrates may form in the gas, thereby plugging the piping system. Accordingly, methanol or other like substances may be injected into the compressed natural gas to alleviate this problem, according to known technology.

It will be still further appreciated by those skilled in the art that as an alternative to the use of an incompressible fluid such as water to drive the free piston toward the gas end of the cylinder in operating the free piston gas delivery apparatus 1 of this invention, an environmentally safe gas such as nitrogen may be used. The gas can be easily vented to the atmosphere after operating the unitary free piston 14 or multiple wafer piston 18 to expel the compressed natural gas from the gas cylinders, respectively.

It is understood that the free piston gas delivery apparatus 1 of this invention may be automated to automatically open and close the respective gas delivery line valves 41 and water return valves 27, in non-exclusive particular, by electrically connecting these valves to the water pump 34 and piston sensors 17 or similar sensors, which operate responsive to movement of the unitary free pistons 14 or multiple wafer pistons 18 in the respective gas cylinders 2.

While the free piston gas delivery apparatus 1 is primarily designed for mounting on a delivery vehicle, it may also be designed for permanent mounting and delivery of compressed natural gas to tank trucks and the like.

Accordingly, the use of a free piston in a cylindrical container or tube for moving compressed natural gas into other containers or vessels by means of a working fluid such as water in various embodiments is envisioned.

Accordingly, while the preferred embodiments of this invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A free piston gas delivery apparatus for mounting on a delivery vehicle having a reference plane parallel to a horizontal reference plane when said vehicle is disposed horizontally, comprising at least one cylinder adapted for mounting on the delivery vehicle in longitudinally tilted relationship with respect to the vehicle reference plane; a free piston slidably disposed in said cylinder for dividing said cylinder into a gas chamber for receiving compressed natural gas and a non-gaseous working fluid chamber for receiving non-gaseous working fluid, said gas chamber being disposed higher than said non-gaseous working fluid chamber; gas conduit means communicating with said gas chamber of said cylinder and gas conduit valve means provided in said gas conduit means for selectively transferring compressed natural gas to and from said gas chamber of said cylinder; at least one non-gaseous working fluid reservoir mounted on said delivery vehicle for containing a supply of non-gaseous working fluid; non-gaseous working fluid conduit means communicating with the interior of said non-gaseous working fluid reservoir and the interior of said non-gaseous working fluid chamber of said cylinder for transferring non-gaseous working fluid therebetween; pump means provided in said non-gaseous working fluid conduit means for pumping non-gaseous working fluid from said non-gaseous working fluid reservoir through said non-gaseous working fluid conduit means to said non-gaseous working fluid chamber of said cylinder, thereby displacing said piston toward said gas chamber to transfer said gas from said gas chamber through said gas conduit means; and non-gaseous working fluid conduit valve means provided in said non-gaseous working fluid conduit means for selectively controlling said pumping and sequentially displacing of said piston to transfer gas from said gas chamber through said gas conduit means and for returning the non-gaseous working fluid from said non-gaseous working fluid chamber to said non-gaseous working fluid reservoir in response to slidable displacement of said free piston in said cylinder toward said non-gaseous working fluid chamber.

2. The free piston gas delivery apparatus of claim 1 wherein said at least one cylinder comprises a plurality of cylinders connected to said gas conduit means and said working fluid reservoir means, respectively.

3. The free piston gas delivery apparatus of claim 1 wherein said working fluid reservoir and further comprises a cylindrical water reservoir and said working fluid is water.

4. The free piston gas delivery apparatus of claim 1 wherein:

(a) said working fluid reservoir further comprises a cylindrical water reservoir and said working fluid is water; and (b) said at least one cylinder comprises a plurality of cylinders connected to said gas conduit means and said cylindrical water reservoir, respectively.

5. The free piston gas delivery apparatus of claim 1 wherein said free piston means further comprises a unitary free piston.

6. The free piston gas delivery apparatus of claim 5 wherein said working fluid reservoir further comprises a cylindrical water reservoir and said working fluid is water.

7. The free piston gas delivery apparatus of claim 6 wherein said at least one cylinder comprises a plurality of cylinders connected to said gas conduit means and said cylindrical water reservoir, respectively.

8. The free piston gas delivery apparatus of claim 7 further comprising baffles provided in said cylindrical water reservoir for reducing sloshing of the water in said cylindrical water reservoir.

9. The free piston gas delivery apparatus of 1 wherein said free piston further comprises a multiple wafer piston.

10. The free piston gas delivery apparatus of claim 9 wherein said working fluid reservoir further comprises a cylindrical water reservoir and said working fluid is water.

11. The free piston gas delivery apparatus of claim 10 wherein said at least one cylinder comprises a plurality of cylinders connected to said gas conduit means and said cylindrical water reservoir, respectively.

12. The free piston gas delivery apparatus of claim 11 further comprising baffles provided in said cylindrical water reservoir for reducing sloshing of the water in said cylindrical water reservoir.

13. The free piston gas delivery apparatus of claim 4 wherein said plurality of cylinders is eight cylinders arranged substantially in a pyramid on said vehicle and said cylindrical water reservoir is disposed substantially in the center of said pyramid.

14. A method for delivery a compressed gas from the gas chamber of at least one cylindrical gas reservoir mounted on a delivery vehicle having a reference plane parallel to a horizontal reference plane when said vehicle is disposed horizontally and having a free piston dividing said cylindrical gas reservoir into said gas chamber and a working fluid chamber, said method comprising the steps of tilting said cylindrical gas reservoir with respect to said vehicle reference plane wherein said gas chamber is disposed higher than said working fluid chamber, introducing a non-gaseous working fluid into said working fluid chamber of said cylindrical gas reservoir, slidably displacing said free piston in said cylindrical gas reservoir and forcing a substantial quantity of the compressed gas from said gas chamber by operation of said free piston and said working fluid, maintaining a selected residual volume of the compressed gas in said gas chamber, releasing the pressure on said working fluid in said working fluid chamber and allowing the residual volume of compressed gas to expand and slidably displace said free piston in the opposite direction in said cylindrical gas reservoir and remove the working fluid from said working fluid chamber.

15. The method according to claim 14 further comprising the step of providing a working fluid reservoir for storing the working fluid, working fluid conduit connecting said working fluid reservoir and said working fluid chamber and working fluid transfer means communicating with said working fluid conduit for transferring working fluid to and from said working fluid reservoir through said working fluid conduit into said working fluid chamber of said cylindrical gas reservoir.

16. The method according to claim 14 further comprising the step of providing gas conduit communicating with said gas chamber for transferring compressed gas to and from said gas chamber of said cylindrical gas reservoir.

17. The method according to claim 14 further comprising the steps of:

(a) providing a working fluid reservoir for storing the working fluid, working fluid conduit connecting said working fluid reservoir and said working fluid chamber and working fluid transfer means communicating with said working fluid conduit for transferring working fluid to and from said working fluid reservoir through said working fluid conduit into said working fluid chamber of said cylindrical gas reservoir; and (b) providing gas conduit communicating with said gas chamber for transferring compressed gas to and from said gas chamber of said cylindrical gas reservoir.

* * * * *